US008658007B2

(12) United States Patent
Pal

(10) Patent No.: US 8,658,007 B2
(45) Date of Patent: Feb. 25, 2014

(54) OXYGEN-PRODUCING INERT ANODES FOR SOM PROCESS

(75) Inventor: Uday B. Pal, Dover, MA (US)

(73) Assignee: The Trustees of Boston University, Boston, MA (US)

( * ) Notice: Subject to any disclaimer, the term of this patent is extended or adjusted under 35 U.S.C. 154(b) by 1052 days.

(21) Appl. No.: 11/994,806

(22) PCT Filed: Jul. 14, 2006

(86) PCT No.: PCT/US2006/027255

§ 371 (c)(1), (2), (4) Date: Jul. 22, 2008

(87) PCT Pub. No.: WO2007/011669

PCT Pub. Date: Jan. 25, 2007

(65) Prior Publication Data

US 2009/0000955 A1 Jan. 1, 2009

Related U.S. Application Data

(60) Provisional application No. 60/699,970, filed on Jul. 15, 2005.

(51) Int. Cl.

| | |
|---|---|
| ***C25C 3/04*** | (2006.01) |
| ***C25C 3/28*** | (2006.01) |
| ***C25C 3/34*** | (2006.01) |
| ***C25C 7/02*** | (2006.01) |

(52) U.S. Cl.

USPC ..... 204/246; 204/266; 204/247; 204/265; 205/367; 205/371; 205/399; 205/400; 205/404

(58) Field of Classification Search

None

See application file for complete search history.

(56) References Cited

U.S. PATENT DOCUMENTS

| | | | | |
|---|---|---|---|---|
| 3,562,135 | A | | 2/1971 | Marincek |
| 3,578,580 | A | * | 5/1971 | Schmidt-Hatting et al. ..... 204/243.1 |
| 4,088,548 | A | * | 5/1978 | Townsend ..... 205/99 |
| 4,108,743 | A | | 8/1978 | Minck |
| 4,804,448 | A | | 2/1989 | Sammells et al. |
| 4,865,925 | A | | 9/1989 | Ludwig et al. |

(Continued)

FOREIGN PATENT DOCUMENTS

| | | |
|---|---|---|
| DE | 1948462 | 4/1971 |
| FR | 1533262 | 5/1967 |
| WO | WO-2004/033760 | 4/2004 |
| WO | WO-2007/011669 | 1/2007 |

OTHER PUBLICATIONS

International Search Report issued for PCT/US06/027255, dated Jul. 24, 2007, 2 pages.

(Continued)

*Primary Examiner* — Harry D Wilkins, III

(74) *Attorney, Agent, or Firm* — Wilmer Cutler Pickering Hale and Dorr LLP

(57) ABSTRACT

An electrolysis system for generating a metal and molecular oxygen includes a container for receiving a metal oxide containing a metallic species to be extracted, a cathode positioned to contact a metal oxide housed within the container; an oxygen-ion-conducting membrane positioned to contact a metal oxide housed within the container; an anode in contact with the oxygen-ion-conducting membrane and spaced apart from a metal oxide housed within the container, said anode selected from the group consisting of liquid metal silver, oxygen stable electronic oxides, oxygen stable crucible cermets, and stabilized zirconia composites with oxygen stable electronic oxides.

5 Claims, 5 Drawing Sheets

(56) References Cited

U.S. PATENT DOCUMENTS

| | | | | |
|---|---|---|---|---|
| 4,908,113 | A | 3/1990 | Marianowski et al. | |
| 4,995,948 | A * | 2/1991 | Poa et al. | 205/47 |
| 5,089,094 | A | 2/1992 | Ogasawara et al. | |
| 5,312,525 | A | 5/1994 | Pal et al. | |
| 5,380,467 | A | 1/1995 | Lin et al. | |
| 5,397,443 | A * | 3/1995 | Michaels | 205/335 |
| 5,454,923 | A * | 10/1995 | Nachlas et al. | 204/270 |
| 5,567,286 | A | 10/1996 | Pal et al. | |
| 5,976,345 | A | 11/1999 | Pal et al. | |
| 6,162,334 | A | 12/2000 | Ray et al. | |
| 2004/0050692 | A1 * | 3/2004 | Lehmann et al. | 204/280 |
| 2004/0194574 | A1 * | 10/2004 | Cardarelli | 75/10.26 |
| 2006/0191799 | A1 * | 8/2006 | Strezov | 205/367 |

OTHER PUBLICATIONS

W.C. Maskall, Inorganic Solid State Chemically Sensitive Devices: Electrochemical Oxygen Gas Sensors, *J. Phys. E: Sci. Instrum*. 20: 1156 (Oct. 1987).

Nisancioglu, et al., Potentiostatic Step Technique to Study Ionic Transport in Mixed Conductors, *Solid States Ionics*, 72: 199 (1994).

Iwase, et al., Eletronically Driven Transport of Oxygen from Liquid Iron to Co + $CO_2$ Gas Mixtures trhough Stabilized Zirconia, *Metallurgical Transactions B*, 12B: 517 (Sep. 1981).

Q. Jaio and N. Themelis *Metallur. Trans. B* 19B: 133 (Feb. 1988).

Bard and Faulkner (*Electrochem. Methods* Chapter 6, John Wiley and Sons, 1980).

* cited by examiner

OXYGEN-PRODUCING INERT ANODES FOR SOM PROCESS

STATEMENT OF GOVERNMENT RIGHTS

This invention was made with Government Support under Contract Number DE-FC36-04GO14011 awarded by the Department of Energy. The Government has certain rights in the invention.

BACKGROUND OF THE INVENTION

Electrolysis is a common form of electrochemical refining. In an electrolysis process, the ore is dissolved in an aqueous or non-aqueous solution or melted in an electrolytic furnace. Once dissolved or melted, the ore dissociates into ionic species, forming an electrolyte. The metallic components of the ore to be extracted become positively charged cations. The remaining components, typically oxygen and halogens, become negatively charged anions. To extract the metal from the ore, an electric potential is applied across two electrodes that are immersed in the electrolyte. The metallic ions are thereby attracted to the negatively charged cathode, where they combine with electrons and are deposited as metal. The counter ions, most typically oxygen and halogens, are driven to the positively charged anode and evolve as waste gases.

Oxygen-ion-conducting membranes, such as yttria-stabilized zirconia, have been used in electrolytic metal extraction processes and permit the extraction of pure metals from their respective oxides. A metal oxide dissolved in a suitable molten electrolyte is separated from the anode by oxygen-ion-conducting membrane. When a potential is generated between the cathode (in contact with the electrolyte) and the anode (in contact with the oxygen-ion-conducting membrane), and the dissociation potential of the oxides are exceeded, the oxygen species of the electrolyte is transported across the ion-conducting membrane and is oxidized at the anode, and the metallic species are reduced at the cathode. This electrochemical cell is referred to as a solid oxide membrane (SOM) cell.

The oxidizing environment of the anode limits the available choices for an anode. In order to reduce the oxidizing environment of the anode, a consumable carbon source or consumable reducing gas such as carbon monoxide (CO) and/or hydrogen is typically continuously fed over the anode to getter or react with the oxygen generated at the anode. This reduces the corrosive oxidative environment at the anode; however, reducing gases and in particular hydrogen are expensive and can add significantly to the cost of metal extraction. Due to the amount of reductant gas required, $H_2$ gas has to be fed in continuously. This puts technique challenges on hydrogen transportation, storage and safety.

An electrolysis cell useful in the synthesis of metals from their respective oxides is desired; in particular, anodes that are stable under oxidizing conditions of the anode are desired. An electrolysis system that does not require a reductant is desired.

SUMMARY OF THE INVENTION

The present invention describes an oxygen producing inert anode. The anode eliminates the need to use hydrogen or CO as getters to react with oxygen. This results in a "greener" SOM process as it can be driven by electricity alone.

In one aspect of the invention, an electrolysis system for generating a metal and molecular oxygen is provided that includes a container for receiving a metal oxide containing a metallic species to be extracted, a cathode positioned to contact a metal oxide housed within the container; an oxygen-ion-conducting membrane positioned to contact a metal oxide housed within the container; an anode in contact with the oxygen-ion-conducting membrane and spaced apart from a metal oxide housed within the container, said anode selected from the group consisting of liquid metal silver or its alloys (Silver-Copper, Silver-Tin etc.), oxygen stable electronic oxides, oxygen stable cermets, and stabilized zirconia composites with oxygen stable electronic oxides.

In another aspect of the invention, a method of metal extraction is provided that includes (a) providing a cell comprising a metal oxide-containing electrolyte comprising a metallic species to be extracted, said electrolyte in communication with a cathode and an oxygen-ion-conducting membrane; and an anode in communication with the oxygen-ion-conducting membrane, said anode selected from the group consisting of liquid metal silver or its alloys (Silver-Copper, Silver-Tin etc.), oxygen stable electronic oxides, oxygen stable cermets, and stabilized zirconia composites with oxygen stable electronic oxides; and (b) applying a potential across the cathode and anode that is greater than the dissociation potential of the metal oxide, wherein the metallic species are reduced at the cathode and the oxygen species are oxidized at the anode to form molecular oxygen.

BRIEF DESCRIPTION OF THE FIGURES

The foregoing and various other aspects, features, and advantages of the present invention, as well as the invention itself, may be more fully appreciated with reference to the following detailed description of the invention when considered in connection with the following drawings. The drawings are presented for the purpose of illustration only and are not intended to be limiting of the invention, in which.

DETAILED DESCRIPTION OF THE INVENTION

Figure 1:
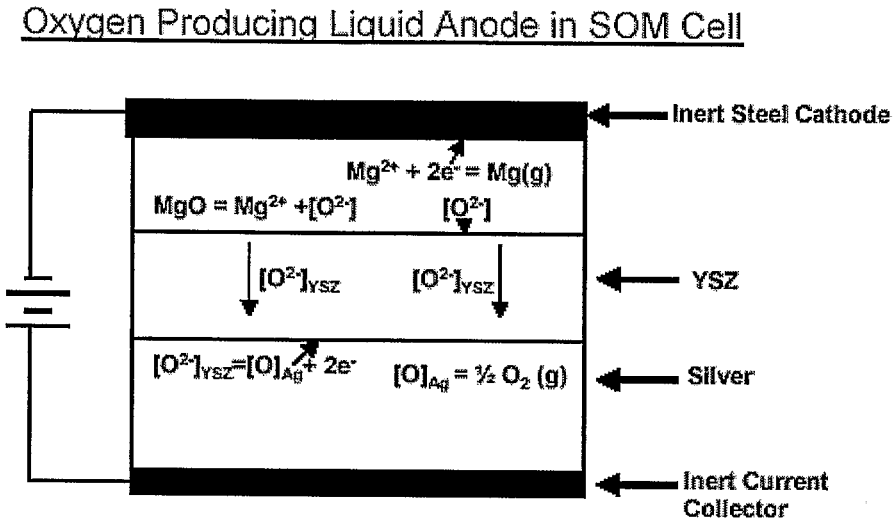
FIG. 1 is a conceptual representation of the solid oxide membrane cell with oxygen producing liquid metal anodes used for electrolyzing exemplary metal oxides (MgO).

An environmentally sound solid-oxide-membrane (SOM) electrolysis system can efficiently synthesize metals and alloys directly from their oxide ores with minimum feed-material preparation and produce oxygen gas or water vapor as the major byproduct. In particular, high-energy-content metals, e.g., metal oxides having large dissociation energies such as magnesium, tantalum and titanium, are synthesized directly from their respective oxides (dissolved in fluoride-based molten fluxes) by employing oxygen-ion-conducting solid electrolyte with an oxygen-producing anode and an inert current collector. During electrolysis, metal cations are reduced at the cathode and molecular oxygen gas is generated at the anode. No gettering gas is required and the oxygen is collected at the anode.

Exemplary oxygen-producing anodes include liquid silver (Ag) or its alloys (Silver-Copper, Silver-Tin etc.), cermets, electronic oxides and composites thereof with stabilized zirconia. The oxygen-producing anode is stable under the oxidizing and high temperature (e.g., >1000° C.) conditions of the anode. Suitable oxygen-producing anodes possess high electronic conductivity (>10 S/cm) and charge transfer/surface exchange kinetics (>10-7 cm/s), are stable in the anodic gas environments and are chemically, mechanically and structurally compatible with the oxygen-ion-conducting membrane.

In one or more embodiments, the oxygen-producing anode is liquid silver and no gettering agent, e.g., $H_2$/CO, is required. The oxygen entering the liquid silver anode through the oxygen-ion-conducting membrane evolves as oxygen gas since silver oxide is not stable at the operating temperature (1100-1300° C.).

In other embodiments, the oxygen producing inert anodes is a porous cermet. The cermet is a composite of an oxygen stable (noble) metal such as iridium or platinum and a stabilized zirconia. The noble metal is capable of withstanding the high temperatures during operation without melting. Stabilized zirconia may be a rare earth element- or alkaline earth-stabilized zirconia, such as zirconia stabilized with yttria, calcium oxide, scandium oxide and the like. The cermet anode is typically coated as a porous thin film on a support, which can be the oxygen-ion-conducting membrane. An exemplary cermet anode is about 20-40% porous to permit molecular diffusion of gases.

In other embodiments, the anode can be an oxygen stable electronic oxide such as strontium-doped lanthanum manganite ($La_{1-x}Sr_xMnO_3$ or LSM). Still other stable electronic oxides include A-site deficient acceptor-doped lanthanum ferrite and lanthanum cobaltite, e.g., $La_{1-x}A_xFeO_3$ or $La_{1-x}A_xCoO_3$. The anode materials may include one or more dopants from the group consisting of Ca, Ce, Pr, Nd, and Gd in the La site and from the group consisting of Ni, Cr, Mg, Al, and Mn in the Fe or Co site; Fe may also be used as a dopant in the cobalt site. The electronic oxide is typically coated as a porous thin film on a support, which can be the oxygen-ion-conducting membrane. An exemplary electronic oxide is about 20-40% porous to permit molecular diffusion of gases.

In still other embodiments, the oxygen-producing anode may be a composite anode including an electronic oxide as described above and a stabilize zirconia as described above. The composite anode is typically coated as a porous thin film on a support, which can be the oxygen-ion-conducting membrane. An exemplary anode is about 20-40% porous to permit molecular diffusion of gases.

The dopant materials and amounts for electronic oxides such as lanthanum ferrite and the lanthanum cobaltite may be selected to decrease the thermal expansion of the ceramic and to provide a closer thermal match to the stabilized zirconia. $La(Ca,Ce,Sm,Pr,Gd,Nd)Fe(Mn,Ni,Al,Cr,Mg)O_{3-x}$ and $La(Ca,Ce,Sm,Pr,Gd,Nd)Co(Mn,Ni,Al,Cr,Mg,Fe)O_{3-x}$ powders of varying compositions can synthesized by mixing high purity precursors of carbonates and oxides in appropriate stoichiometric ratios and calcining them at a temperature of 1200-1300° C. for 4 hours in air. The calcined powders can be lightly crushed using an alumina mortar and pestle and the calcination step can be repeated to complete the solid-state reaction. The lanthanum ferrite and lanthanum cobaltite cathode materials systems may be fabricated on the appropriate support material and are typically prepared on the oxygen-ion-conducting membrane. In one or more embodiments, the porous anode is supported on a YSZ membrane.

Suitable solid oxide electrolytes for use as the oxygen-ion-conducting membrane are solid solutions (i.e., solid "electrolytes") formed between oxides containing divalent and trivalent cations such as alkaline earth oxides, e.g., calcium oxide, or rare earth oxides, e.g., scandium oxide, yttrium oxide, lanthanum oxide, etc., and oxides containing tetravalent cations such as zirconia, hafnia, thoria and ceria. The oxygen ion-conducting materials or phases may be an oxygen-ion-conductive mixed metal oxide having a fluorite structure. The oxygen ion conducting material may be a doped fluorite compound. The higher ionic conductivity is believed to be due to the existence of oxygen ion site vacancies. One oxygen ion vacancy occurs for each divalent or each two trivalent cations that are substituted for a tetravalent ion in the lattice.

Any of a large number of oxides such as rare earth doped zirconia-, ceria-, hafnia-, or thoria-based materials may be used as the solid oxide electrolyte. Some of the known solid oxide materials include rare earth or alkaline earth-doped zirconia-, ceria-, hafnia-, and thoria-based oxides, such as $Y_2O_3$-stabilized $ZrO_2$ (YSZ), CaO-stabilized $ZrO_2$, $Sc_2O_3$-stabilized $ZrO_2$, $Y_2O_3$-stabilized $CeO_2$, CaO-stabilized CeO, GaO-stabilized $CeO_2$, $ThO_2$, $Y_2O_3$-stabilized $ThO_2$, or $ThO_2$, $ZrO_2$, $CeO_2$, or $HfO_2$ stabilized by addition of any one of the lanthanide oxides or CaO. Additional examples include strontium- and magnesium-doped lanthanum gallate (LSGM). Many other oxides are known which have demonstrated oxygen ion-conducting ability, which could be used as the oxygen-ion-conducting membrane. The solid oxide electrolyte membrane can be in any shape. One particularly convenient shape is tubular, with one end of the tube being closed. Another suitable shape is in the form of a flat sheet or incorporated into a container for holding the molten metal flux.

The system and method according to one or more embodiments of the present invention may be use to extract high energy content metals, such as magnesium. The current production methods for magnesium are either metallothermic reduction (magnetherm process) at high temperatures (1,600° C.) involving expensive metal reductant (FeSi) or electrolysis from a halide electrolyte bath that requires extensive and expensive feed-material preparation. Both these techniques are also energy intensive, have low yield and generate large quantities of waste reaction products harmful to the environment. In the SOM process, the oxide reduction is electrochemical and has efficiencies close to 100%. Unlike the current metallothermic and the electrolytic processes, the SOM is more economic and less energy intensive, and its process products are environmentally benign.

FIG. 1 shows the SOM cell configuration for synthesizing Mg from MgO with oxygen producing liquid silver anode. The experimental cell with liquid silver anode can be described as:

Ag (l)/Yttria Stabilized Zirconia (YSZ)/ionic flux with dissolved MgO/Steel.

The individual half-cell reactions can be written as follows:

At the cathode: $Mg_{2+}+2e^- \rightarrow Mg(g)$

At the flux/YSZ interface: $O^{2-}(flux)=O^{2-}(YSZ)$

At YSZ/liquid anode interface: $O^{2-}(YSZ)=[\underline{O}]_{Ag\ anode}+2e^-$ and $[O]_{Ag\ anode}=\frac{1}{2}O_2(g)$ Overall cell reaction can be given as: $Mg^{2+}+O^{2-}=Mg(g)+O_2(g)$ In this process the oxygen-ion-conducting membrane, shown here as YSZ, separates the inert cathode and the flux from the liquid metal anode or the oxygen-producing anode. The Mg-containing flux has high ionic conductivity, high oxide solubility and low viscosity. In the exemplary system of FIG. 1, the dissolved oxide in the flux is MgO. When the applied electrical potential between the electrodes exceeds the dissociation potential of the oxide, oxygen ions are pumped out of the flux and through the YSZ membrane to the anode. Mg(g) evolves at the inert cathode (steel) that is condensed in a separate chamber yielding a high-purity Mg metal. If liquid anode is used, the oxygen dissolves in the liquid anode, $[O]_{Anode}$, and evolves as oxygen gas $O_2$(g).

Liquid silver (Ag (l)) electrode serves as a medium to carry out the charge-transfer reaction involving oxygen ions and soluble oxygen at the YSZ/silver interface followed by oxygen gas evolution as shown in the above figure. Liquid metal anodes such as silver have low vapor pressure, high oxygen solubility and high oxygen diffusivity in the temperature range of interest. Other oxygen-producing anodes that are stable under the oxidizing conditions of the anode may be used. Such anodes include cermets, electronic oxides such as strontium-doped lanthanum manganite ($La_{1-x}Sr_xMnO_3$ or LSM), acceptor-doped lanthanum ferrite and lanthanum cobaltite materials, e.g., $La_{1-x}A_xFeO_3$ or $La_{1-x}A_xFeO_3$, and composites thereof with stabilized zirconia.

The anodic and cathodic reactions and the transport of various species are as shown in FIG. 1. The rate of the slowest step determines the overall metal production rate in the cell. In order to increase the overall rate, the rate of the slowest step needs to be enhanced. The flux is an electron blocker and ionic resistance of the flux is much smaller than that of the YSZ membrane. Adequate stirring of the flux and having sufficient MgO in the flux are help to ensure that transport in the flux is rapid. The temperature is sufficiently high (≥1000° C.) so charge transfer reactions are rapid. Since the oxygen solubility and diffusivity are high in the liquid anode and the anode is well stirred by the evolving $O_2$(g), oxygen transport in the liquid anode is also rapid. The free energy change of oxygen evolution under applied potential at these temperatures indicates that the oxygen evolution occurs readily.

Figures 2A, 2B:
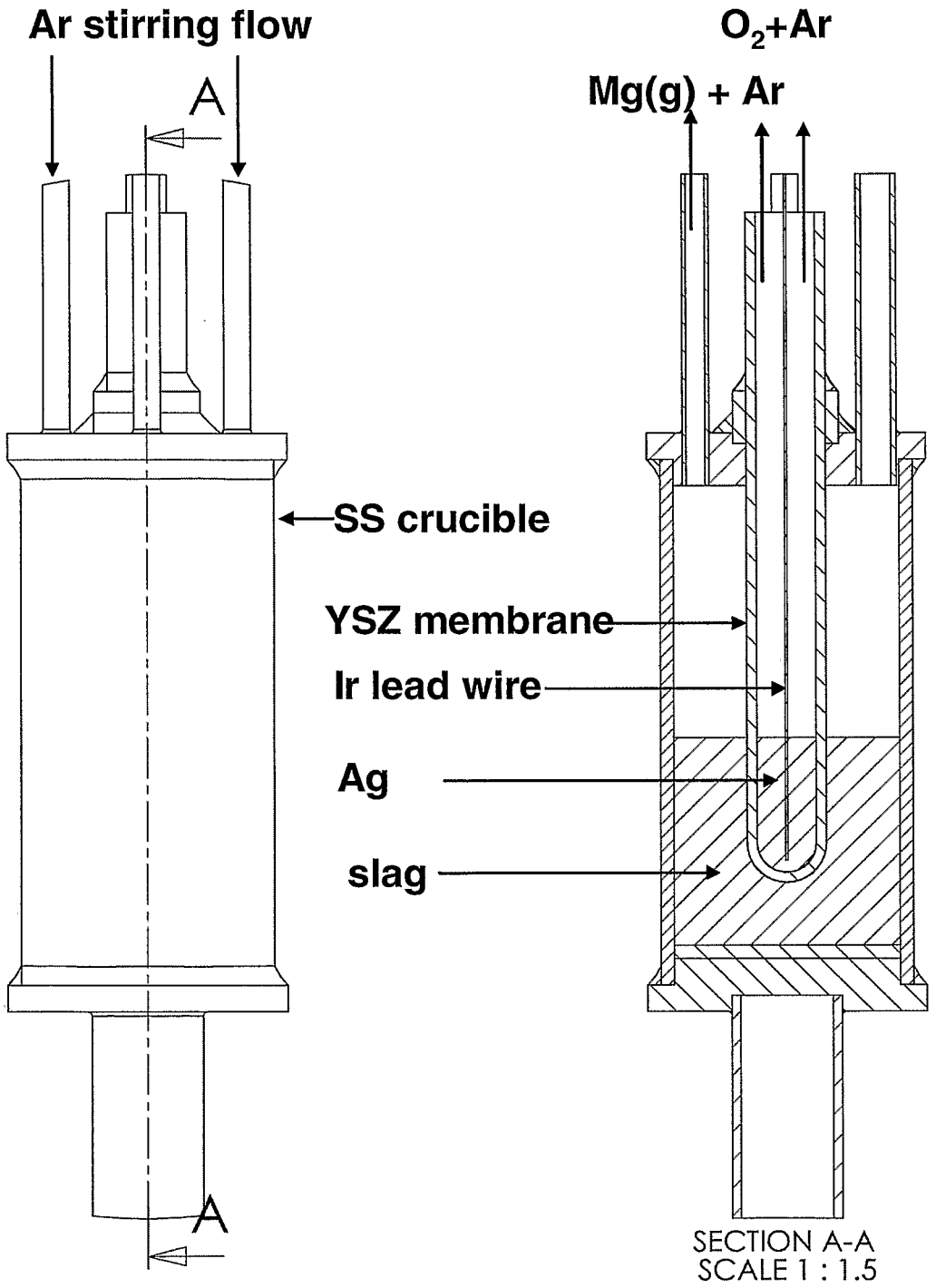
FIG. 2A is a schematic illustration of the reactor employing a yttria-stabilized zirconia (YSZ) tube as part of the solid oxide membrane cell with an oxygen-generating liquid metal anode for electrolyzing MgO.
FIG. 2B is a cross-sectional view of the reactor across line A-A.

The production of magnesium without reductant gases is described. Magnesium is produced by SOM process without any reductant feeding and it is expected that oxygen generated at the anode can be separated from the exhaust gas flow for other industrial applications. With reference to FIG. 2A, an exemplary electrolytic cell and magnesium collection apparatus is designed to produce and contain 100-200 g of magnesium metal. The electrolytic cell shown in cross-section along line A-A in FIG. 2B. The electrolyte cell can utilize up to 33 $cm^2$ of the liquid anode area and operate at anodic current densities as high as 1 $A/cm^2$. The YSZ solid electrolyte is in the form of a one-end-closed tube (1.9 cm OD, 1.42 cm ID, 20 cm long) that contains the liquid anode. Experiments were conducted employing liquid silver as the anode. Due to silver's high oxygen solubility, diffusivity and wetting of the YSZ membrane, it was used inside the YSZ membrane, as a connection between YSZ membrane and iridium lead wire (current collector). Other noble metals such as platinum or a solid (non-porous) sintered rod of the aforementioned anode material (electronic oxides, cermets and electronic oxide composites) may also be used as current collectors. The steel crucible that holds the MgO containing ionic flux served as the cathode. In order to protect the YSZ tube above the flux from the Mg vapor that was produced along the wall of the stainless steel container (cathode), argon gas was introduced into the chamber as a carrier gas and diluent. The argon-magnesium gas mixture passed out of the electrolysis chamber to the lower condensation chamber (not shown) where the Mg(g) was condensed.

During operation, a DC voltage greater than the dissociation potential of MgO was applied. $Mg^{2+}$ cations moved toward the cathode, gained electrons and were reduced to Mg. At the experimental temperature 1150° C., Mg evolved as Mg gas. $O^{2-}$ anions in the slag, driven by electrochemical potential difference, passed through the YSZ membrane, which is an oxygen ion conductor, toward the anode. At the interface of membrane and silver, $O^{2-}$ lost electrons, and associated with each other to form $O_2$ gas and the $O_2$ gas was carried away by input Ar gas flow.

Figure 3:
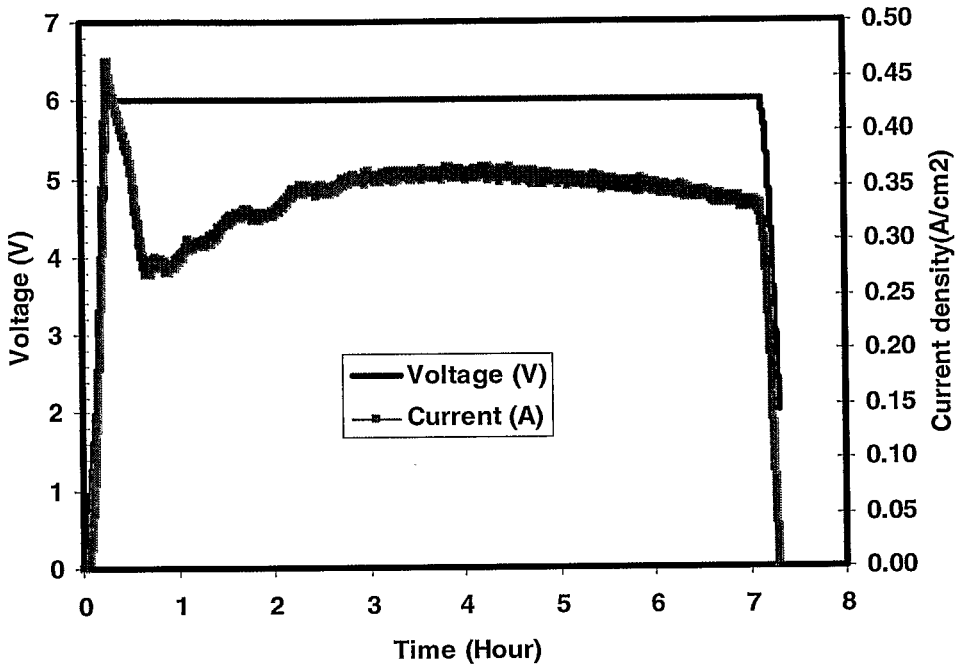
FIG. 3 is a plot of potential (and current density) vs. time during operation of the reactor according to one or more embodiments of the current invention.

As shown in FIG. 3, during the SOM experiment, a DC voltage was applied between anode and cathode, the voltage was initial increased linearly from 0 volt to 6 volt and kept at 6 volt for 6.5 hours. FIG. 3 also shows, through the current density versus time curve, that the cell became stable in about three hours and after one and half hours, the current density started decreasing.

After experiment, the stainless thin foil with the collected magnesium was pulled out from the condenser and the total weight was measured. Compared with the weight of the stainless steel sheet without magnesium condensation, it turned out that 8.1 grams of magnesium was produced. EDAX analysis shows the product is pure magnesium.

The cell was characterized using impedance spectroscopy, potentio-dynamic sweeps and potentio-static holds. The electrochemical instrumentation consists of a Princeton Applied Research (PAR) potentiostat (Model 263 A) and Solartron impedance analyzer (Model 1250 B). A KEPCO® power booster was used to increase the current limit of the potentiostat to 10 amps. Data acquisition and control of the above instruments was achieved with CorrWare® and Zplot® (software) from Scribner Associates (Southern Pines, N.C.). A Hewlett Packard power supply (Model 6033A) was used to apply a constant potential to the cell for electrolysis. The applied electrical potential and resulting current from the cell were logged at 1 second intervals using a Fluke Hydra® data logger (Model 2635A).

Figure 4:
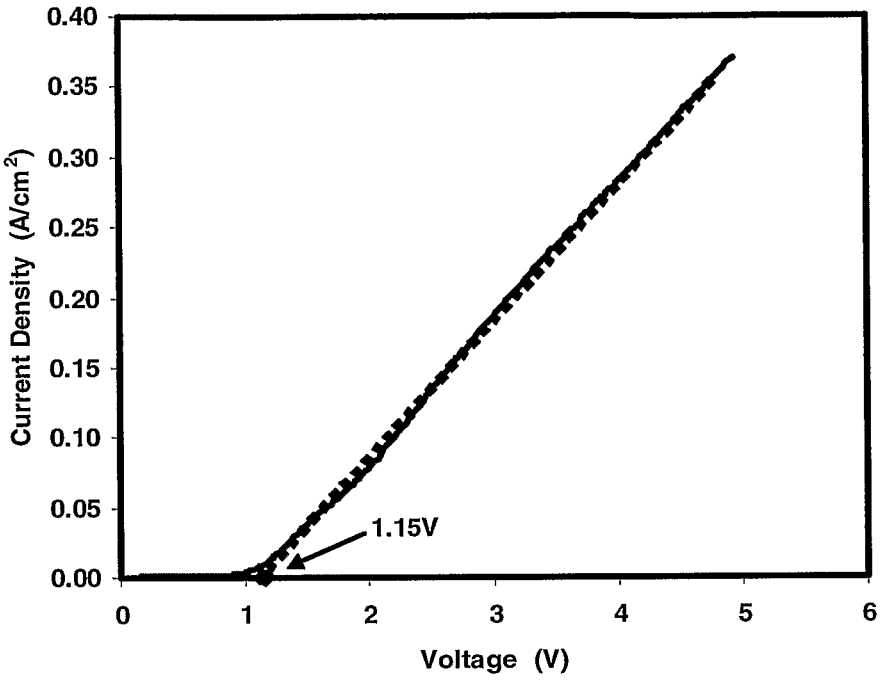
FIG. 4 is a plot of current density vs. applied potential for an MgO electrolysis at 1150° C. showing the dissociation potential of MgO without the use of reductants.
Figure 5:
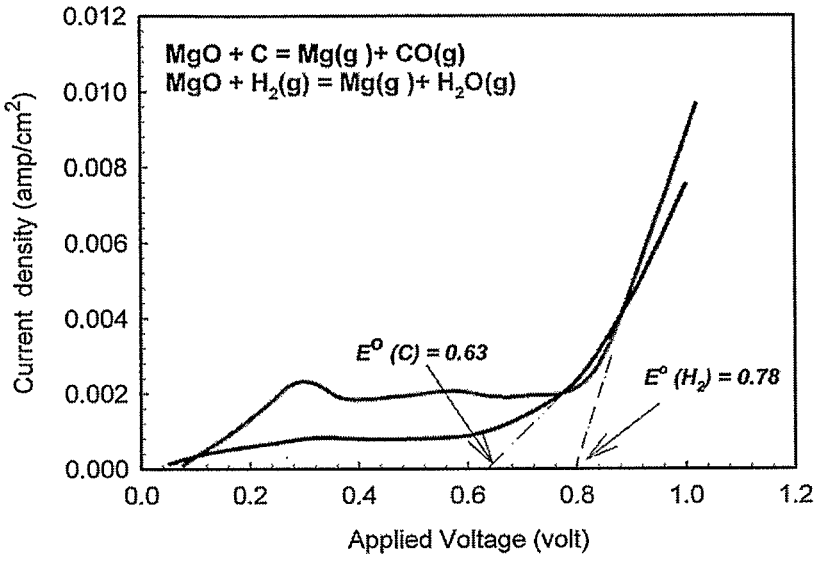
FIG. 5 is a plot of current density vs. applied potential for an MgO electrolysis at 1150° C. showing the dissociation potential of MgO with hydrogen or carbon as a reductant.

The MgO dissociation potential measurement for the above cell was determined based on the setup response to the slow potenio-dynamic sweep (scan rate=0.5 mV/sec) across the cell, as is shown in FIG. 4. FIG. 4 shows the results of potentio-dynamic sweep and indicates that the dissociation potential of MgO in the experiment is about 1.15 V, which is higher than the dissociation potentials when either carbon or hydrogen is used as reductant (shown in FIG. 5). Comparison between FIG. 4 and FIG. 5 shows that to obtain the same current density, higher voltage has to be applied in the SOM experiment without reductant than in the SOM experiment with either carbon or hydrogen as reductant. This suggests that the to get the same amount of magnesium, more electrolyte power (5% more when applied potential is 6 V) has to be used in an oxygen-producing system, but this can be justified by the savings in the carbon or hydrogen feeding during magnesium production, and the benefit of oxygen obtained.

What is claimed is:

1. An electrolysis system for generating a metal and molecular oxygen, comprising:

a container for receiving a metal oxide containing a metallic species to be extracted, a cathode positioned to contact the metal oxide housed within the container;

an oxygen-ion-conducting membrane positioned to contact the metal oxide housed within the container;

an anode in contact with the oxygen-ion-conducting membrane and spaced apart from the metal oxide housed within the container, said anode selected from the group consisting of liquid metal silver or its alloys; and an input for introducing an inert stirring gas to flow through the anode.

2. The electrolysis system of claim 1, wherein the oxygen ion-conducting membrane is selected from the group consisting of rare earth doped zirconia-, ceria-, hafnia-, and thoria-based oxides.

3. The electrolysis system of claim 1, wherein the membrane comprises yttria-stabilized zirconia.

4. The electrolysis system of claim 1, wherein the metal is selected from the group consisting of magnesium, tantalum and titanium.

5. An electrolysis system for generating a metal and molecular oxygen, comprising:

a container for receiving a metal oxide containing a metallic species to be extracted, a cathode positioned to contact the metal oxide housed within the container;

an oxygen-ion-conducting membrane positioned to contact the metal oxide housed within the container;

an anode in contact with the oxygen-ion-conducting membrane and spaced apart from the metal oxide housed within the container, said anode selected from the group consisting of liquid silver-copper and silver-tin.

* * * * *

UNITED STATES PATENT AND TRADEMARK OFFICE

CERTIFICATE OF CORRECTION

PATENT NO. : 8,658,007 B2
APPLICATION NO. : 11/994806
DATED : February 25, 2014
INVENTOR(S) : Uday B. Pal It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1370 days.

Signed and Sealed this
Twenty-ninth Day of September, 2015

Michelle K. Lee

Michelle K. Lee
*Director of the United States Patent and Trademark Office*